US010422077B2

(12) United States Patent
Li et al.

(10) Patent No.: US 10,422,077 B2
(45) Date of Patent: Sep. 24, 2019

(54) CONTINUOUS HORIZONTAL DIGESTER

(71) Applicant: Hao Li, Weifang, Shandong (CN)

(72) Inventors: Hao Li, Weifang (CN); Jiachuan Chen, Jinan (CN)

(73) Assignee: Hao Li, Weifang, Shandong Province (CN)

( * ) Notice: Subject to any disclaimer, the term of this patent is extended or adjusted under 35 U.S.C. 154(b) by 0 days.

(21) Appl. No.: 15/549,206

(22) PCT Filed: Feb. 1, 2016

(86) PCT No.: PCT/CN2016/073070

§ 371 (c)(1),
(2) Date: Aug. 7, 2017

(87) PCT Pub. No.: WO2016/124121

PCT Pub. Date: Aug. 11, 2016

(65) Prior Publication Data

US 2018/0044854 A1 Feb. 15, 2018

(30) Foreign Application Priority Data

Feb. 6, 2015 (CN) ..... 2015 1 0064999

(51) Int. Cl.

| | |
|---|---|
| ***D21C 7/02*** | (2006.01) |
| ***D21C 7/00*** | (2006.01) |
| ***D21C 7/06*** | (2006.01) |
| ***D21C 7/08*** | (2006.01) |
| ***D21C 7/10*** | (2006.01) |

(52) U.S. Cl.
CPC ..... *D21C 7/02* (2013.01); *D21C 7/00* (2013.01); *D21C 7/06* (2013.01); *D21C 7/08* (2013.01); *D21C 7/10* (2013.01)

(58) Field of Classification Search
USPC ..... 162/233
See application file for complete search history.

(56) References Cited

FOREIGN PATENT DOCUMENTS

CN 202081331 * 12/2011 ..... D21C 7/00

OTHER PUBLICATIONS

CN 202081331(U) Gangrong Li et al., Dec. 2011, machine translation, D21C 7/00, 7/12.*

* cited by examiner

*Primary Examiner* — Mark Halpern
(74) *Attorney, Agent, or Firm* — Li & Cai Intellectual Property (USA) Office

(57) ABSTRACT

The instant disclosure provides a continuous horizontal digester including a cylindrical pressure cooker capable of rotating by taking its central axis as an axis; a charging apparatus disposed at one end of the cooker which is communicated with an inner cavity of the cooker and can seal the cooker; and a discharging device disposed at the other end of the cooker and communicated with the inner cavity of the cooker, the discharging device is located on the central axis of the cooker. The continuous horizontal digester further includes a cooking device configured to cook the materials in the cooker.

10 Claims, 4 Drawing Sheets

4
6
2
9
B
A
15
16
14
C
D
A
19
18
13
1
3
14

CONTINUOUS HORIZONTAL DIGESTER

This application is a 371 of PCT/CN2016/073070 filed on 1 Feb. 2016.

BACKGROUND

1. Technical Field

The instant disclosure relates to equipment for manufacturing papers, in particular, to a continuous horizontal digester for sufficiently mixing and cooking grass, woods and chemical solutions to obtain a slurry for producing papers.

2. Description of Related Art

Digesters are equipment widely used in the paper manufacturing industry. Digesters can sufficiently mix and cook grass or woods with chemical solutions under a high-temperature and high-pressure environment for obtaining a slurry for producing papers. The mixing and cooking efficiency of the digesters are a critical parameter for the production efficiency and the quality of the manufactured paper products.

In the existing art, digesters are divided into two main categories: vertical digesters and horizontal digesters. For a horizontal digester, a common spherical pot can be used to achieve intermittent cooking. However, a horizontal digester cannot be used to continuously cook and produce slurry for obtaining paper products. Therefore, the existing horizontal digesters have lower efficiency. More importantly, the horizontal digester cannot provide satisfied efficiency when performing gas-liquid-solid mixing. For example, when cooking oxygen-alkali materials, the liquid and solid are concentrated at the lower portion of the spherical pot and the gases are concentrated at the upper portion of the spherical pot, and hence, these reactants cannot be sufficiently and efficiently mixed, thus providing an unsatisfied cooking result. Another common structure design for a horizontal pot is to form a cooking line with a plurality of (at least four) horizontal tubes connected in series. In order to ensure the cooking efficiency, these horizontal tubes are arranged sequentially from top to bottom and the continuous cooking can be achieved by the augers in the horizontal tubes and the gravity of the slurries. These type of digesters have many disadvantages since a single pot (tube) has a height of about one floor: the building cost is high due to the need of floors in a building for the plurality of horizontal tubes; the horizontal pot (tube) on each floor needs an independent power system for providing power, thereby increasing the overall power consumption; and all of the augers can only push the slurries to move towards a fixed direction and cannot provide sufficient mixing in the pots and are not suitable for oxygen-alkali cooking. For vertical digesters, this type of pots can only perform intermittent cooking of the slurries for manufacturing papers and have lower cooking efficiency. In addition, since the liquid-solid mixture are usually located at the bottom end of the pot and the gas is located at the upper portion of the vertical digester, a sufficiently and efficiently mixing and cooking cannot be achieved.

SUMMARY

The instant disclosure provides a continuous digester with a rotatable cooker which can increase the uniformity of the cooking process and reduce the liquid ratio, and is suitable for a gas phase cooking process.

In order to achieve the above objects, an embodiment of the instant disclosure provides a continuous digester including a cylindrical pressure cooker capable of rotating along a central axis thereof, a charging device disposed on an end of the cooker, a discharging device disposed on the other end of the cooker and a cooking device for cooking a material inside of the cooker. The charging device is configured to seal the cooker and is communicated with the cooker, and the discharging device is communicated with the cooker and located on the central axis of the cooker.

In an embodiment of the instant disclosure, the charging device includes a charging case divided into at least two parts communicated with each other, one of the two parts being communicated with the inner cavity of the cylindrical pressure cooker and rotating synchronously with the cylindrical pressure cooker along the central axis of the cylindrical pressure cooker, the other one of the two parts being fixed and connected to a charging opening, a sealing device being disposed between the two parts of the charging case.

In an embodiment of the instant disclosure, the charging device further includes a feed screw disposed inside of the charging case, the feed screw being coincided with the central axis of the cylindrical pressure cooker and rotating relative to the cylindrical pressure cooker.

In an embodiment of the instant disclosure, a sealing plate is disposed in the cylindrical pressure cooker and covers an end opening of the charging case, a limiting component being fixed outside of an end cover of the cylindrical pressure cooker, the limiting component applying a pulling force toward a direction opposite to a charging direction on the sealing plate.

In an embodiment of the instant disclosure, the feed screw has a compression ratio and the charging case has a plurality of filtering holes. In addition, the continuous horizontal digester further includes a water-collecting case covering the charging case and being fixed and connected to the charging opening, wherein the water-collecting case has an inclined lower surface connecting to a water-discharging opening located at the lowest position of the inclined lower surface.

In an embodiment of the instant disclosure, a bearing for eliminating a bounce of the cylindrical pressure cooker is disposed at a connection location between the charging case and the charging opening.

In an embodiment of the instant disclosure, a feeder is connected to the charging case, the feeder being capable of feeding the material to the cylindrical pressure cooker and to prevent the pressure in the cylindrical pressure cooker from leaking, the feeder being connected to the charging opening.

In an embodiment of the instant disclosure, a plurality of rising plates are disposed on an inner wall of the cylindrical pressure cooker, the plurality of rising plates being separately disposed along an axis of the cooker, an annulus baffle plate being disposed between any two adjacent rising plates.

In an embodiment of the instant disclosure, a helical feeding blade and a stirrer are disposed on an inner wall of a charging end of the cylindrical pressure cooker.

In an embodiment of the instant disclosure, the feeder includes an assisted feed screw located above the feed screw, the assisted feed screw having a compression ratio, the charging opening being located above the assisted feed screw, a discharging opening of the assisted feed screw having a sealing plate for applying a force having a direction opposite to the charging direction on the material.

One of the advantages of the instant disclosure is that the rotation of the cylindrical pressure cooker enables the continuous digester to achieve the sufficient mixing effect, and the cooking device can facilitate the reaction of the materials (mixtures) in the cooker for achieving sufficient reaction efficiency. Lastly, the slurries for manufacturing paper are discharged from the discharging device from the cooker under a high-pressure condition. Therefore, the efficiency for cooking is increased and the mixing effect between the materials and the chemical solution is improved, and hence, the efficiency of the digester is improved.

The structural design of the two-part charging case and the sealing device located between the two parts of the charging case can prevent the pressure inside of the cooker from leaking. One of the two parts of the charging case is communicated with the inner cavity of the cooker and is coaxial with the cooker, and the other one of the two parts of the charging case is fixed and connected to the charging opening.

When the feed screw rotates, the materials disposed at the charging opening can be pressed and move forwards and along the charging case. Therefore, material blocks with high density are formed at the connection location between the charging case and the cooker. A sealing plate disposed inside of the cooker and covering the end opening of the charging case applies an inverse force on the material blocks based on the function of a limiting component until the material blocks push away the limiting component and enter the cooker. During the above process, the high pressure in the cooker resulted from the cooking device will tightly press the sealing plate on the end opening of the charging case, thereby preventing the pressure inside of the cooker from leaking. Accordingly, the cooking efficiency can be ensured.

The plurality of filtering holes on the charging case can remove water from the material while the feed screw presses the material blocks. The water from the filtering holes flows to the water-collecting case and are discharged from the water-discharging opening. Therefore, a part of water in the material is prevented from entering the cooker.

Regarding the cooking device, high-temperature and high-pressure steam can be input into the cooker by an input tube or by arranging a jacket outside of the cooker. Heat-conducting oil which can prevent excess water to be added into the slurry inside of the cooker can be used. Therefore, the cooking efficiency can be ensured.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DESCRIPTION OF THE EXEMPLARY EMBODIMENTS

Figure 1:
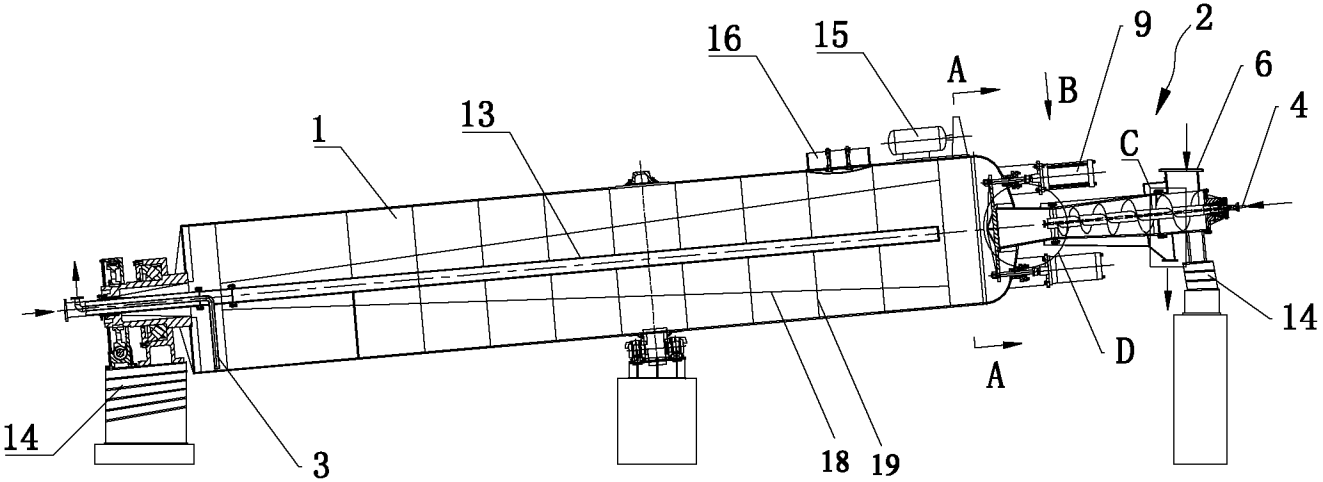
FIG. 1 is a structural schematic view of an embodiment of the instant disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

First Embodiment

Reference is made to FIG. 1. The digester includes a cylindrical cooker 1. The cooker 1 can be arranged horizontally or can incline for an angle relative to a horizontal plane. The charging end (on the right side of the figure) is higher than the discharging end (on the left side of the figure), and a supporting plate 14 can be disposed below the ends of the cooker 1 for adjusting the inclined angle of the cooker according to actual needs. The cooker 1 can have a shape of a pyramid (with the charging end larger than the discharging end) or an inverse pyramid. In another embodiment, the cooker 1 can be an elliptical cylinder or having a shape of two cones in combination (with the dimension in the center larger than the dimension of the two ends). In order to improve the force received by the cooker 1, at least an end of the cooker can have a shape of semi-circle. The shape of the cooker can be changed based on different needs and is not limited in the instant disclosure.

The difference between the continuous horizontal digester (of the instant disclosure) and the digester in the existing art is that the cooker 1 of the continuous horizontal digester can rotate along a central axis thereof. Therefore, the material in the digester can be mixed excellently. The digester mainly includes a charging device, a discharging device and a cooking device. These components are described in detail herein.

As shown in FIG. 1, FIG. 3, FIG. 4 and FIG. 5, the charging device 2 of the first embodiment includes a charging opening 6. The charging opening 6 is fixed and connected to a charging case 5. The charging case 5 includes two parts communicated with each other. A sealing device is disposed between the two parts of the charging case 5. A part adjacent to the charging opening 6 is fixed to the charging opening 6, and the other part which is adjacent to the cooker 1 is communicated with the inner cavity of the cooker 1. The part communicated with the inner cavity of the cooker rotates synchronously with the cooker 1, and the boundary between the part of the charging case 5 rotating with the cooker 1 and the fixed part of the charging case 5 is preferably located at a helix non-compression part adjacent to the charging opening 6. Therefore, the sealing device can be arranged easily, i.e., the sealing device can be arranged by creating a contacting surface between the rotatable part of the charging case 5 and the fixed part of the charging case 5. A feed screw 7 (auger) is disposed inside of the charging case 5. The feed screw 7 is coincided with the central axis of the cooker 1 and can be driven and rotated by a power mechanism, thereby pushing the material feed fed from the charging opening 6 to move along the charging case 5 into the cooker 1. The feed screw 7 rotates relative to the cooker 1. In the first embodiment, the feed screw 7 is a feed screw with a compression ratio, i.e., the diameter of the feed screw 7 decreases towards the moving direction of the material feed. The diameter of the charging case 5 decreases along the transportation of the material feed. The advantage of the above design is that the material feed is pushed and pressed to form material blocks with high density, and hence, water remained in the material feed can be removed. In addition, in order to collect the removed water, a plurality of filtering holes are disposed on the charging case 5, i.e., the charging case 5 can be used as a filtering plate. A water-collecting case 10 covering and surrounding the charging case 5 is fixed to the charging opening 6. The water-collecting case 10 has an inclined lower surface and a water-discharging opening 11 is disposed on the lowest position of the inclined lower surface.

The chemical solution input into the cooker 1 for conducting reactions can be input through a channel on the central axis of the feed screw 7. The channel forms a chemical solution input tube 4. The chemical solution can also be mixed with the material feed and input from the charging opening 6. The chemical solution can be input by other technical means. Another means for inputting the chemical solution into the cooker is described below.

Generally, the cooker 1 has a diameter of about 2 meters and a length of about 10 meters. A bounce of the cooker 1 relative to the charging opening 6 can be generated during the rotation of the cooker 1. In order to eliminate the bounce, at least a bearing 12 is disposed at the connecting location between the charging case 5 and the charging opening 6. At least a part of the charging case 5 can allow limited movement at three dimensions for ensuring the fit tolerance between the two parts.

Figure 2:
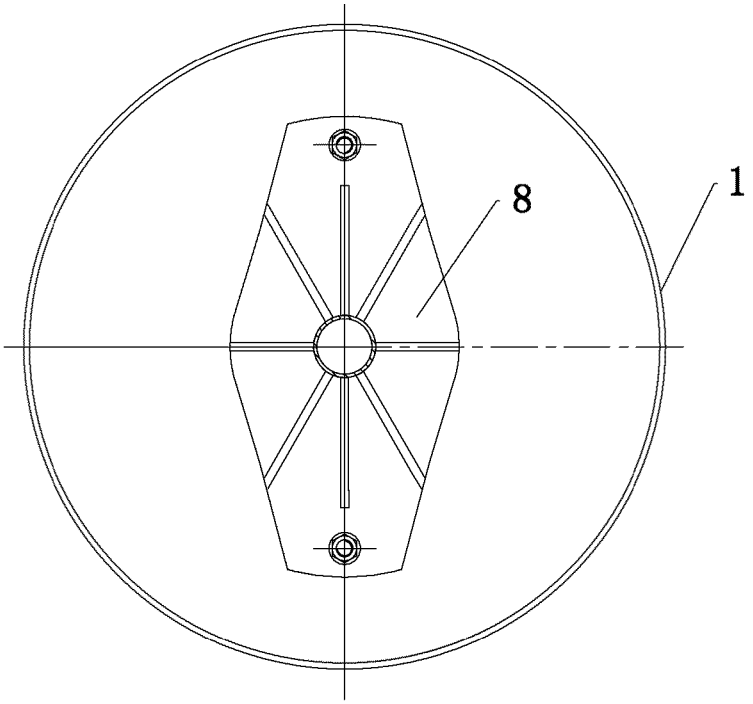
FIG. 2 is a sectional schematic view taken along line A-A of FIG. 1.
Figure 3:
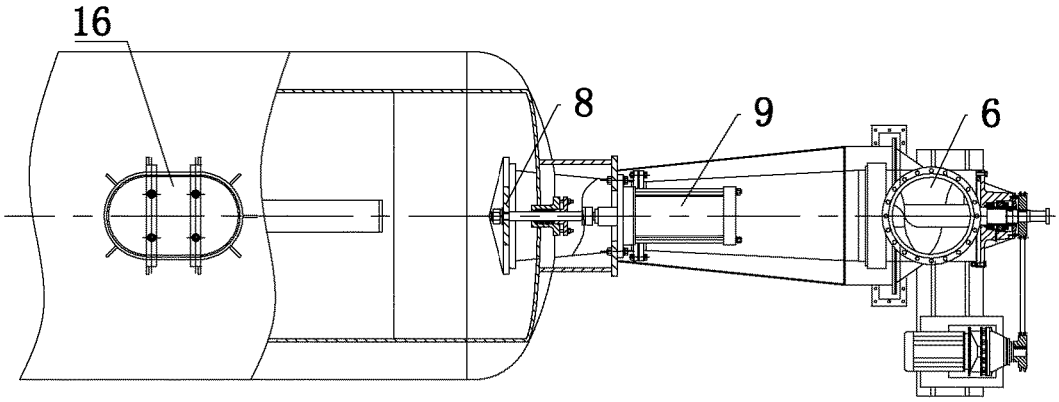
FIG. 3 is a schematic view taken along the direction B of FIG. 1.
Figure 4:
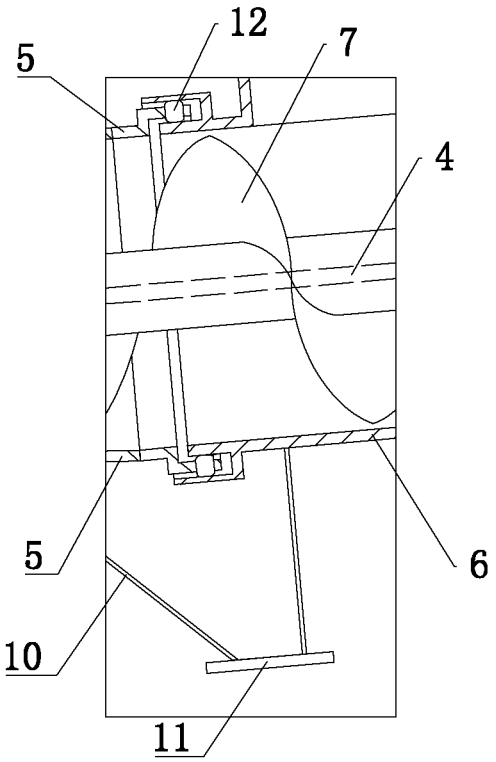
FIG. 4 is a partial enlarged view of part C of FIG. 1.
Figure 5:
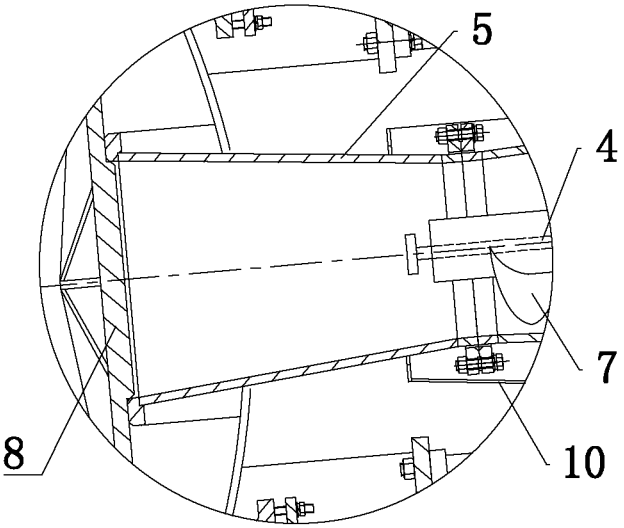
FIG. 5 is a partial enlarged view of part D of FIG. 1.

As shown in FIG. 1, FIG. 2 and FIG. 5, a sealing plate 8 is disposed inside of the cooker and covering the end opening of the charging case 5. A limiting component is fixed on the outer portion of the end of the cooker 1. In the first embodiment, the limiting component includes two air cylinders 9 applying a pulling force having a direction opposite to the charging direction on the sealing plate 8 for ensuring the sealing plate 8 to tightly press the end opening of the charging case 5. Such a structure can enable the sealing plate 8 to tightly press the end opening of the charging case 5 by the high pressure inside of the cooker 1 formed by the cooking process conducted by the cooking device, thereby preventing the pressure inside of the cooker from leaking and ensuring the cooking efficiency. When the feed screw 7 with a compression ratio rotates, the material input from the charging opening 6 can be pressed and transported along the charging case 5 and form material blocks with high density at the connection point between the charging case 5 and the cooker 1. The sealing plate 8 disposed inside of the cooker 1 and covering the end opening of the charging case 5 produces an inverse force on the material block by the air cylinders 9 until the material blocks push the sealing plate 8 away and enter the cooker by the feed screw 7. The force applied by the sealing plate 8 can come from an oil cylinder, and an oil pump providing power to the oil cylinder can be fixed on the cooker 1 and rotate with the cooker 1.

In the first embodiment, the discharging device includes a slurry-output tube 3 extending inside of the cooker 1. The end of the slurry-output tube 3 is located at the lowest end of the cooker 1. Under the high pressure condition in the cooker 1, the slurry for producing paper formed by the cooking process will be slowly discharged from the slurry-output tube 3.

The cooking device of the first embodiment can have two different structures. As shown in FIG. 1, one of the structures for the cooking device includes an air-input tube 13 extending into the cooker 1 for inputting a steam flow with high temperature and high pressure into the cooker 1. Under this circumstance, the air-input tube 13 and the chemical solution input tube 4 can be designed as a same tube, i.e., the air-input tube 13 can be used to input not only steam but also the chemical solution.

Another structure design for the cooking device is to arrange a jacket outside of the cooker 1. The jacket is filled with heat-conducting oil and a heat-conducting oil output opening is disposed on the jacket for discharging the heat-conducting oil after the heat conducting process. The heat-conducting oil is used to cook the slurring inside of the cooker 1. This type of structure design can avoid the slurry inside of the cooker 1 including excess water and ensure the efficiency of the cooking process.

In order to increase the mixing effect of the materials inside of the cooker, a plurality of rising plates 18 can be disposed on the inner wall of the cooker 1. The rising plates 18 are separately disposed inside of the cooker 1 along an axis of the cooker 1, and an annulus baffle plate 19 can be disposed between any two adjacent rising plates 18. When the cooker 1 rotates, these rising plates 18 can continuously rotate and raise the slurry inside of the cooker 1 for improving the mixing effect of the slurry. In addition, a helical feeding blade and a stirrer can be disposed on the inner wall of the charging end of the cooker 1 for further enhancing the mixing effect of the slurry.

The manhole 16 disposed on the cooker 1 can enable the user to inspect and maintain the cooker 1 and an air compression machine 15 can provide power to the air cylinder.

Second Embodiment

Figure 6:
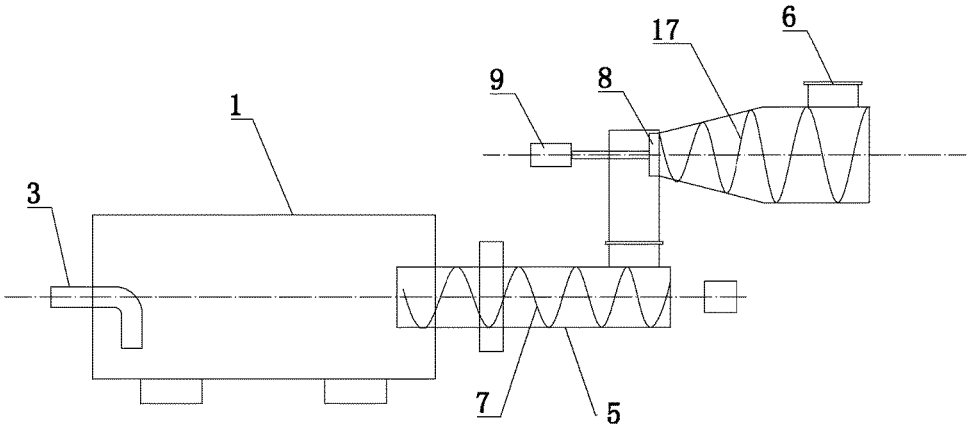
FIG. 6 is a structural schematic view of another embodiment of the instant disclosure.

Reference is now made to FIG. 6. The difference between the second embodiment and the first embodiment is that the structures of the charging devices are different. The structures of the other devices (such as the discharging device and the cooking device) are shown in the figure in a brief way. The charging device of the second embodiment includes a feeder connected to the charging opening 6 for providing material into the inner cavity of the cooker 1 and preventing the pressure inside of the cooker 1 from leaking. The feeder includes an assisted feed screw 17 located above the feed screw 7. The assisted feed screw 17 has a compression ratio. The charging opening 6 is located above the assisted feed screw 17. A sealing plate 8 for applying a force with a direction opposite to the charging direction is disposed at the discharging opening of the assisted feed screw 17.

The charging case 5 of the second embodiment has a two-part structure. The sealing device between the two parts of the charging case 5 requires a strict sealing effect for sealing not only the material but also the gas and liquid in the charging case 5.

The feed screw 7 and the assisted feed screw 17 are disposed toward the same direction. The assisted feed screw 17 has a compression ratio and is disposed between the charging opening 6 and the fixed part of the charging case 5. The sealing plate 8 of the second embodiment is disposed at the discharging end of the assisted feed screw 17. The limiting component (i.e., the air cylinder 9) is connected to the sealing plate 8 for applying a force having a direction opposite to the charging direction on the sealing plate 8. Therefore, the chemical solution inside of the cooker 1 can be prevented from ejecting by the high-pressure condition.

The discharging opening of the feed screw 7 directly connected to the cooker 1 has a sealing plate for assisting the sealing effect of the cooker 1 when the first sealing plate fails.

The other components of the second embodiment are similar to the first embodiment and are not described in detail herein.

For the continuous horizontal digester of the instant disclosure, the other charging devices (such as compartment assisted screw feeder, compartment assisted free-fall feeding (free-feed)) can be used in combination with the discharging device and the cooking device for solving the corresponding technical problems and achieving corresponding technical effects. These structures are known in the technical field and are not described in detail herein.

The continuous horizontal digester of the instant disclosure has a simple structure, and is easy to operate and can effectively perform the mixing process of the material for enhancing the cooking efficiency.

The above-mentioned descriptions represent merely the exemplary embodiment of the instant disclosure, without any intention to limit the scope of the instant disclosure thereto. Various equivalent changes, alterations or modifications based on the claims of the instant disclosure are all consequently viewed as being embraced by the scope of the instant disclosure.

What is claimed is:

1. A continuous horizontal digester comprising:

a cylindrical pressure cooker configured to rotate along a central axis thereof;

a charging device disposed on an end of the cylindrical pressure cooker and communicated with an inner cavity of the cylindrical pressure cooker, the charging device being configured to seal the cylindrical pressure cooker;

a discharging device disposed on the central axis of the cylindrical pressure cooker and communicated with the inner cavity of the cylindrical pressure cooker; and a cooking device for cooking a material in the cylindrical pressure cooker;

wherein the charging device includes a charging case divided into at least two parts communicated with each other, one of the two parts being communicated with the inner cavity of the cylindrical pressure cooker and rotating synchronously with the cylindrical pressure cooker along the central axis of the cylindrical pressure cooker, the other one of the two parts being fixed and connected to a charging opening, a sealing device being disposed between the two parts of the charging case.

2. The continuous horizontal digester according to claim 1, wherein the charging device further includes a feed screw disposed inside of the charging case, the feed screw being coincided with the central axis of the cylindrical pressure cooker and rotating relative to the cylindrical pressure cooker.

3. The continuous horizontal digester according to claim 2, wherein a sealing plate is disposed in the cylindrical pressure cooker and covers an end opening of the charging case, a limiting component being fixed outside of an end cover of the cylindrical pressure cooker, the limiting component applying a pulling force toward a direction opposite to a charging direction on the sealing plate.

4. The continuous horizontal digester according to claim 2, wherein the feed screw has a compression ratio and the charging case has a plurality of filtering holes;

wherein the continuous horizontal digester further includes a water-collecting case covering the charging case and being fixed and connected to the charging opening, and wherein the water-collecting case has an inclined lower surface connecting to a water-discharging opening located at the lowest position of the inclined lower surface.

5. The continuous horizontal digester according to claim 1, wherein a bearing for eliminating a bounce of the cylindrical pressure cooker is disposed at a connection location between the charging case and the charging opening.

6. The continuous horizontal digester according to claim 1, wherein a feeder is connected to the charging case, the feeder being configured to feed the material to the cylindrical pressure cooker and to prevent the pressure in the cylindrical pressure cooker from leaking, the feeder being connected to the charging opening.

7. The continuous horizontal digester according to claim 6, wherein the feeder includes an assisted feed screw located above the feed screw, the assisted feed screw having a compression ratio, the charging opening being located above the assisted feed screw, a discharging opening of the assisted feed screw having a sealing plate for applying a force having a direction opposite to the charging direction on the material.

8. The continuous horizontal digester according to claim 1, wherein a plurality of rising plates are disposed on the inner wall of the cylindrical pressure cooker, the plurality of rising plates being separately disposed along an axis of the cooker, an annulus baffle plate being disposed between any two adjacent rising plates.

9. The continuous horizontal digester according to claim 1, wherein a helical feeding blade and a stirrer are disposed on an inner wall of a charging end of the cylindrical pressure cooker.

10. The continuous horizontal digester according to claim 1, wherein the cylindrical pressure cooker is tiltable.

* * * * *